US009164478B2

(12) United States Patent
Hirose

(10) Patent No.: US 9,164,478 B2
(45) Date of Patent: Oct. 20, 2015

(54) IMAGE FORMING APPARATUS HAVING A CONVEYING PATH FORMATION MEMBER INCLUDING THROUGH HOLES

(75) Inventor: Atsuo Hirose, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 223 days.

(21) Appl. No.: 13/433,662

(22) Filed: Mar. 29, 2012

(65) Prior Publication Data

US 2012/0251156 A1 Oct. 4, 2012

(30) Foreign Application Priority Data

Mar. 29, 2011 (JP) ..... 2011-071997

(51) Int. Cl.
*G03G 21/20* (2006.01)
*G03G 15/00* (2006.01)

(52) U.S. Cl.
CPC ..... *G03G 21/206* (2013.01); *G03G 15/657* (2013.01); *G03G 2215/00675* (2013.01)

(58) Field of Classification Search
CPC ..... G03G 15/657; G03G 21/206; G03G 2215/00675
USPC ..... 399/397, 400
See application file for complete search history.

(56) References Cited

U.S. PATENT DOCUMENTS 4,875,063 A 10/1989 Idenawa et al.
5,016,060 A * 5/1991 Arai ..... 399/400
7,457,573 B2 * 11/2008 Tsujita ..... 399/315
7,532,853 B2 * 5/2009 Shimizu ..... 399/400
7,805,087 B2 * 9/2010 Sunada ..... 399/21
2003/0185584 A1 * 10/2003 Hirose et al. ..... 399/92
2007/0008396 A1 1/2007 Shimizu
2010/0025918 A1 * 2/2010 Miyazawa ..... 271/12
2010/0232846 A1 * 9/2010 Watanabe ..... 399/322

FOREIGN PATENT DOCUMENTS

JP S63-66585 A 3/1988
JP HEI 06-138786 A 5/1994
JP HEI 06-186873 A 7/1994

(Continued)

OTHER PUBLICATIONS

JP Office Action mailed Jul. 9, 2013, JP Appln. 2011-071997, English translation.

*Primary Examiner* — Ryan Walsh
*Assistant Examiner* — Philip Marcus T Fadul
(74) *Attorney, Agent, or Firm* — Banner & Witcoff, Ltd.

(57) ABSTRACT

An image forming apparatus includes an image forming unit configured to form an image on a transfer-receiving member conveyed from a first side to a second side, and a fixing device disposed on a side of the image forming unit closer to the second side, and configured to fix the image formed on the transfer-receiving member. A conveying path formation member is configured to form a conveying path along which the transfer-receiving member is conveyed from the image forming unit to the fixing device. The conveying path formation member includes a first member having first through holes in the up-down direction, and a second member having second through holes in the up-down direction, wherein the second member faces the first member such that the second through holes do not overlap the first through holes when projected in the up-down direction.

20 Claims, 7 Drawing Sheets

(56) References Cited

FOREIGN PATENT DOCUMENTS

| | | | |
|---|---|---|---|
| JP | HEI 06-239490 | A | 8/1994 |
| JP | HEI 08-217288 | A | 8/1996 |
| JP | HEI 11-305637 | A | 11/1999 |
| JP | 2002-023439 | A | 1/2002 |
| JP | 2007-017888 | A | 1/2007 |
| JP | 2010-176006 | A | 8/2010 |

* cited by examiner

図1

IMAGE FORMING APPARATUS HAVING A CONVEYING PATH FORMATION MEMBER INCLUDING THROUGH HOLES

CROSS REFERENCE TO RELATED APPLICATIONS

This application claims priority from Japanese Patent Application No. 2011-071997, filed on Mar. 29, 2011, the entire subject matter of which is incorporated herein by reference.

BACKGROUND

1. Field

The disclosure relates to an electrophotographic image forming apparatus.

2. Description of the Related Art

An electrophotographic printer is provided with a photoconductor drum and a fixing device. The photoconductor drum carries a developer image thereon, which is to be transferred to a paper sheet. The transferred developer image is fixed with heat to the paper sheet by the fixing device.

In such a printer, the temperature of the fixing device becomes high. In order to prevent air heated by the fixing device from flowing toward the photoconductor drum, an air curtain (i.e., an air flow) has been provided between the photoconductor drum and the fixing device.

For example, an image forming apparatus is proposed in Japanese Unexamined Patent Application Publication No. 11-305637 which is provided with a process cartridge, a fixing device, an electronic circuit board and a fan. The process cartridge is provided with a photoconductor drum. The electronic circuit board is located below the process cartridge and the fixing device via a partition plate which has an opening. The fan is for cooling the electronic circuit board. Ambient air introduced through the fan is made to pass between the process cartridge and the fixing device via the opening of the partition plate.

SUMMARY

According to the art described above, it is possible that, if a developing agent drops off a paper sheet which is being conveyed from the process cartridge to the fixing device, the dropped developing agent may adhere to the electronic circuit board via the opening.

Aspects of the disclosure provide an image forming apparatus which is capable of forming an air flow between an image forming unit and a fixing device. If a developing agent yet to be fixed drops off a paper sheet, the image forming unit can prevent the dropped developing agent from being scattered outside of a conveying path.

DETAILED DESCRIPTION

1. Entire Configuration of Printer

Figure 1:
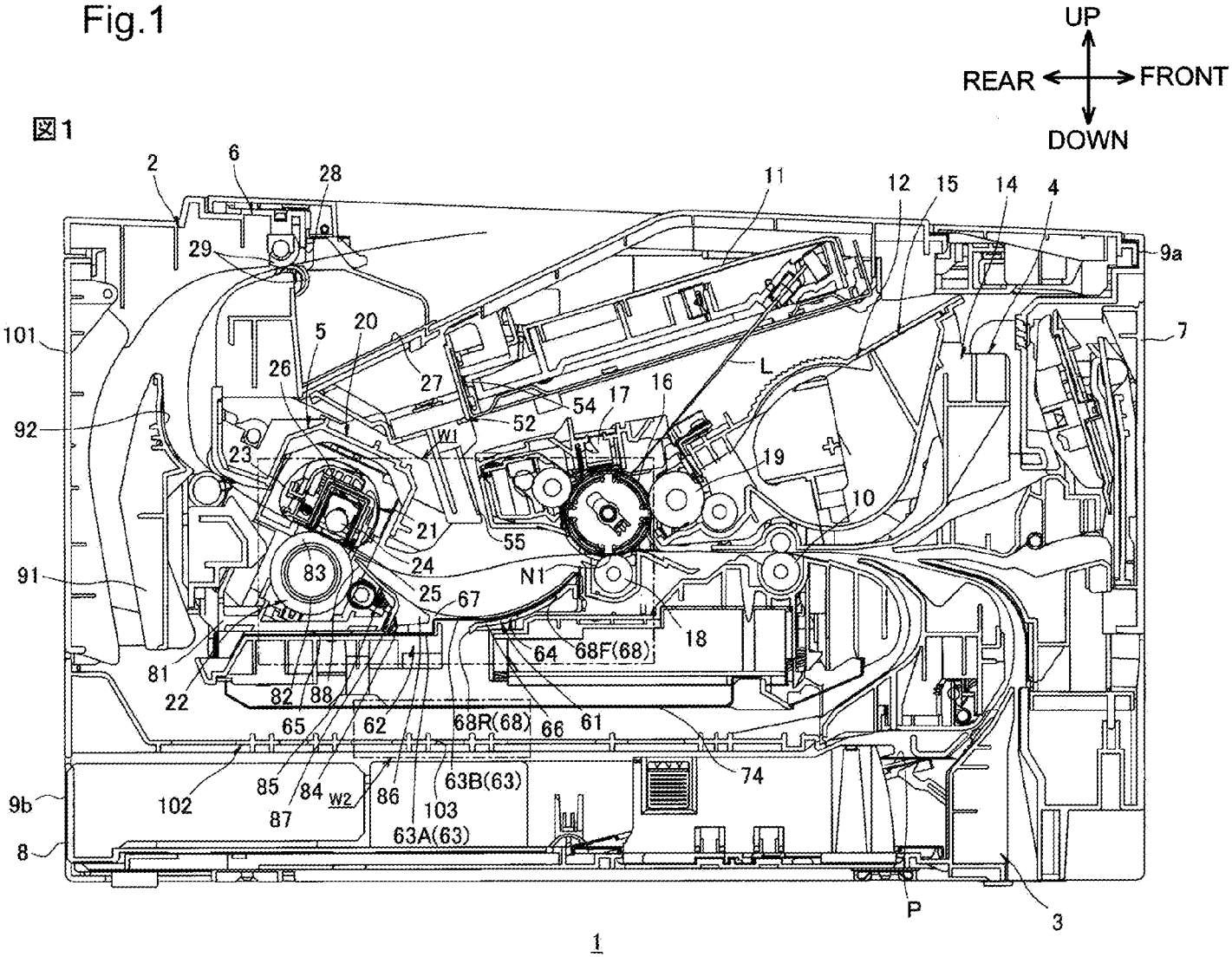
FIG. 1 illustrates, in a sectional view, a printer as an illustrative image forming apparatus.

As illustrated in FIG. 1, an illustrative image forming apparatus in the form of a printer is provided with a paper feeding unit 3, an image forming unit 4, a fixing unit 5 and a paper sheet discharge unit 6 which are held in a main body casing 2 as an illustrative apparatus main body.

A front cover 7 is provided on a side wall 9*a* on one horizontal end or a front or first side of the main body casing 2. The front cover 7 can be opened and closed for the removal and replacement of a process cartridge 12, which will be described below. A side wall 9*b* is provided on the other horizontal end or rear or second side of the main body casing 2 so as to face and be spaced apart from the side wall 9*b*.

In the following description, the side of one horizontal end (the right side of FIG. 1 seen from above) at which the front cover 7 is provided is defined as the front side, and the side of the other horizontal end (the left side of FIG. 1 seen from above) opposite to the front side is defined as the rear side. The left side and right side of the printer 1 are defined with respect to the front side of the printer 1. In particular, the near side of FIG. 1 is the left side and the far side of FIG. 1 is the right side. The left-right direction is an illustrative orthogonal direction.

(1) Paper Feeding Unit

The paper feeding unit 3 is provided with a paper feed tray 8 which holds a transfer-receiving member, which in this example is a paper sheet P. The paper feed tray 8 may be located at a lower end inside the main body casing 2 and can be configured to be removed and replaced from the front side.

When a paper sheet feed roller (not illustrated) located above the front end of the paper feed tray 8 is driven to rotate, the paper sheets P held in the paper feed tray 8 transferred one at a time upward and turned, and conveyed toward a resist roller 10 along a paper sheet feeding side U-shaped path. The resist roller 10 is located on the front side of the photoconductor drum 16, which will be described below. When the resist roller 10 is driven to rotate, the paper sheet P is conveyed at predetermined times to the image forming unit 4 (i.e., to a contact area N1 of the photoconductor drum 16 and a transfer roller 18, which will be described below).

In particular, a leading end (i.e., a downstream end in the conveying direction) of the turned paper sheet P is conveyed substantially horizontally from the front (i.e., one horizontal end) side toward the rear (i.e., the other horizontal end) side.

(2) Image Forming Unit

The image forming unit 4 is provided with a scanner unit 11 and a process cartridge 12.

(2-1) Scanner Unit

The scanner unit 11 is located at an upper end inside the main body casing 2. The scanner unit 11 outputs a laser beam L toward the photoconductor drum 16 of the process cartridge 12 and scans a surface of the photoconductor drum 16 with the laser beam L moved in one of the left and right directions at high speed.

(2-2) Process Cartridge

The process cartridge 12 is located below the scanner unit 11. The process cartridge 12 may be provided with a drum cartridge 14 and a development cartridge 15. The development cartridge 15 can be attached to the drum cartridge 14 to be removable and replaceable.

The photoconductor drum 16, which is substantially cylindrical in shape and extending in the left-right direction, is rotatably attached to the drum cartridge 14. The photoconductor drum 16 is driven to rotate by the driving force from a motor 13 (see FIG. 6) provided inside the main body casing 2.

The drum cartridge 14 is provided with a scorotron charging unit 17 and a transfer roller 18.

The development cartridge 15, which is located on the front side of the photoconductor drum 16, is provided with a developing roller 19.

The developing roller 19 is rotatably supported at the rear end of the development cartridge 15 to be exposed from the rear side. The developing roller 19 faces and contacts the photoconductor drum 16 to press the same from the front side.

Developing agents such as positively-charging non-magnetic single-component toner corresponding to each color can be received in the development cartridge 15 and output via an opening on the rear side to the developing roller 19.

(2-3) Development and Transfer

Toner in the development cartridge 15 is positively charged as the developing roller 19 is driven to rotate and is carried on a surface of the developing roller 19.

A surface of the photoconductor drum 16 is positively charged uniformly by the scorotron charging unit 17 as the photoconductor drum 16 is driven to rotate, and is then exposed to high-speed scanning with the laser beam L output by the scanner unit 11. In this manner, an electrostatic latent image corresponding to an image to be formed on the paper sheet P is formed on the surface of the photoconductor drum 16.

As the photoconductor drum 16 is driven to further rotate, the toner carried on the surface of the developing roller 19 is supplied to the electrostatic latent image formed on the surface of the photoconductor drum 16.

Thus, the electrostatic latent image on the photoconductor drum 16 is visualized and a toner image produced by reversal development is carried on the surface of the photoconductor drum 16. The toner image is transferred to the paper sheet P when the paper sheet P reaches the contact area N1 of the photoconductor drum 16 and the transfer roller 18.

(3) Fixing Unit

The fixing unit 5 is provided on the rear side (i.e., the side of the other horizontal end) of the process cartridge 12. The fixing unit 5 is provided with a fixing device 20.

The fixing device 20 is provided with a heating unit 21 and a fixing roller 22.

The heating unit 21 is provided with heating film 23, a heating member 24, a nip plate 25 and a reflector plate 26.

The heating film 23, which is heat resistant and flexible, is formed in a substantially cylindrical shape extending in the left-right direction. The heating film 23 is supported to be circumferentially rotatable in the fixing device 20 and is driven to rotate following the rotation of the fixing roller 22.

The heating member 24, which is a halogen lamp, is formed as a shaft extending in the left-right direction inside the heating film 23.

The nip plate 25 is formed as a substantially flat plate extending in the left-right direction, and is disposed between the heating member 24 and the heating film 23 so as to contact an inner surface of the heating film 23.

The reflector plate 26 has a substantially U-shaped cross section which is opened at a lower end thereof and extends in the left-right direction. The lower end of the reflector plate 26 engages the nip plate 25 from above to surround the nip plate 25 together with the heating member 24.

The nip plate 25, the reflector plate 26 and the heating member 24 are pressed against the fixing roller 22 in an integrated manner by an urging member (not illustrated).

The fixing roller 22 is provided with a hollow rotational axis 82 and a sponge roller 83 which surrounds the rotational axis 82. The fixing roller 22 is driven to rotate by the driving force from the motor 13 (see FIG. 6) which is shared by the photoconductor drum 16.

When the paper sheet P passes between the heating film 23 and the fixing roller 22, the toner image on the paper sheet P is fixed to the paper sheet P with heat and pressure.

(4) Paper Sheet Discharge Unit

The paper sheet discharge unit 6 is provided with a paper output tray 27.

The paper output tray 27 is formed on an upper surface of the main body casing 2 as a substantially V-shaped recess which is opened at an upper end thereof. The paper sheet discharge unit 6 includes a paper sheet outlet 28 through which the paper sheet P is output.

The paper sheet outlet 28 is formed in a substantially rectangular shape when seen in a front view (see FIG. 2) and extends in the left-right direction so as to penetrate a rear wall of the paper output tray 27 in the front-rear direction. A pair of output rollers 29 for conveying the paper sheet P to the paper output tray 27 is provided next to the paper sheet outlet 28. The output rollers 29, which are rotatable in the forward and backward directions, rotate forward to convey the paper sheet P to the paper output tray 27 and rotate backward to convey the paper sheet P to a second conveying path, which will be described below, inside the main body casing 2.

The paper sheet P having the toner image transferred thereto is conveyed to between the output rollers 29 and is output to the paper output tray 27 through the paper sheet outlet 28 by the forward rotation of the output rollers 29.

2. Exhaust Unit and Duct Member

Figure 2:
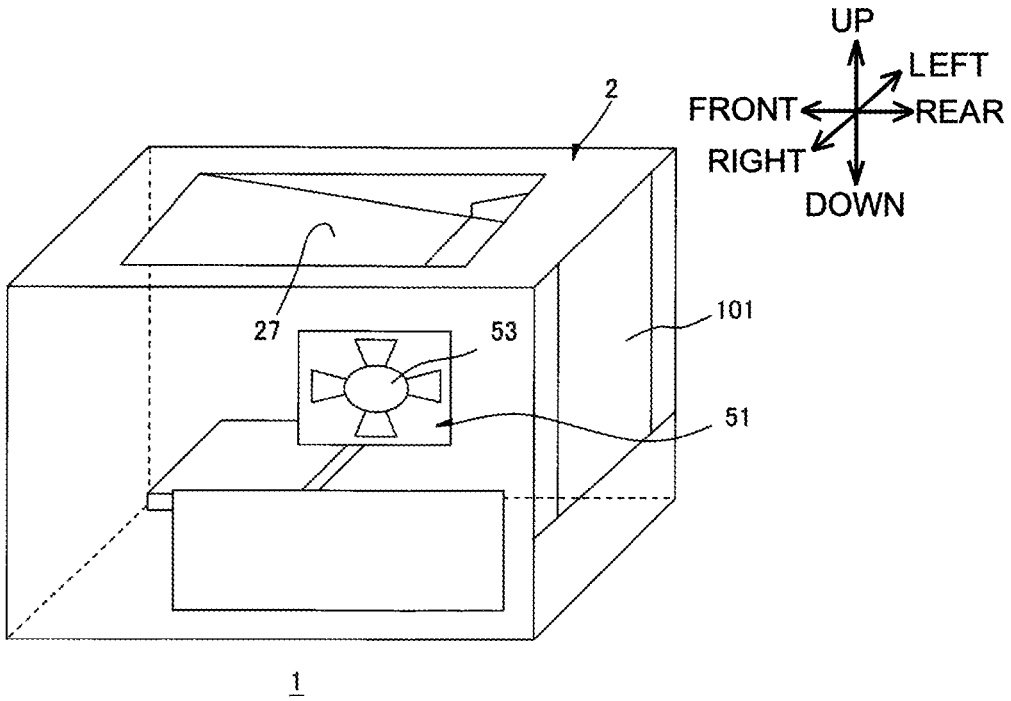
FIG. 2 illustrates, in a perspective view of a main body casing viewed from an upper right side, an arrangement of an exhaust unit in the printer illustrated in FIG. 1.

As illustrated in FIGS. 1 and 2, the main body casing 2 is provided with an exhaust unit 51 (see FIG. 2) which discharges air from the main body casing 2, and a duct member 52 (see FIG. 1) which guides air in the main body casing 2 to the exhaust unit 51.

The exhaust unit 51 is provided with a rotatable fan 53 and is fixed to a right wall of the main body casing 2 so as to be located between the photoconductor drum 16 and the fixing device 20 when projected in the left-right direction. The exhaust unit 51 discharges air from the main body casing 2 through an exhaust port (not illustrated) that passes through the right wall of the main body casing 2.

The duct member 52 is formed in a substantially cylindrical shape extending in the left-right direction at the left side of the exhaust unit 51. In particular, the duct member 52 is provided with a duct body 54 and a duct partition plate 55. The duct body 54 is located at the left side of the exhaust unit 51 and faces the exhaust unit 51. The duct partition plate 55 extends downward from the duct body 54 and is located between the process cartridge 12 and the fixing device 20.

The duct body 54 is formed in a substantially rectangular pipe shape extending in the left-right direction and opening at an upper end thereof. In particular, the duct body 54 is formed in a substantially trapezoidal shape with an upper base longer than a lower base when seen in a side view.

The duct partition plate 55 is formed in a substantially rectangular pipe shape extending downward from a lower end of the duct body 54 and opens at both upper and lower ends.

The length of the duct partition plate 55 in the front-rear direction is shorter than the length of the duct body 54 in the front-rear direction.

An upper end of the duct partition plate 55 is disposed inside the duct body 54, and a lower end of the duct partition plate 55 is disposed between the process cartridge 12 and the fixing device 20.

The lower end of the duct partition plate 55 is located above a second line L2 (described below, see FIG. 6), which is a conveyance path of the paper sheet P, to avoid interfering with a paper sheet P that is being conveyed from the process cartridge 12 to the fixing device 20.

3. Details of First Conveying Path (1) First Lower Wall Formation Member

A first conveying path formation member such as a first lower wall formation member 61 (see FIG. 4) is provided in the main body casing 2 as illustrated in FIG. 1. The first lower wall formation member 61 forms a lower wall of the first conveying path, which will be described below, at a position spaced above the paper feed tray 8 and between the photoconductor drum 16 and the fixing device 20.

Figure 3:
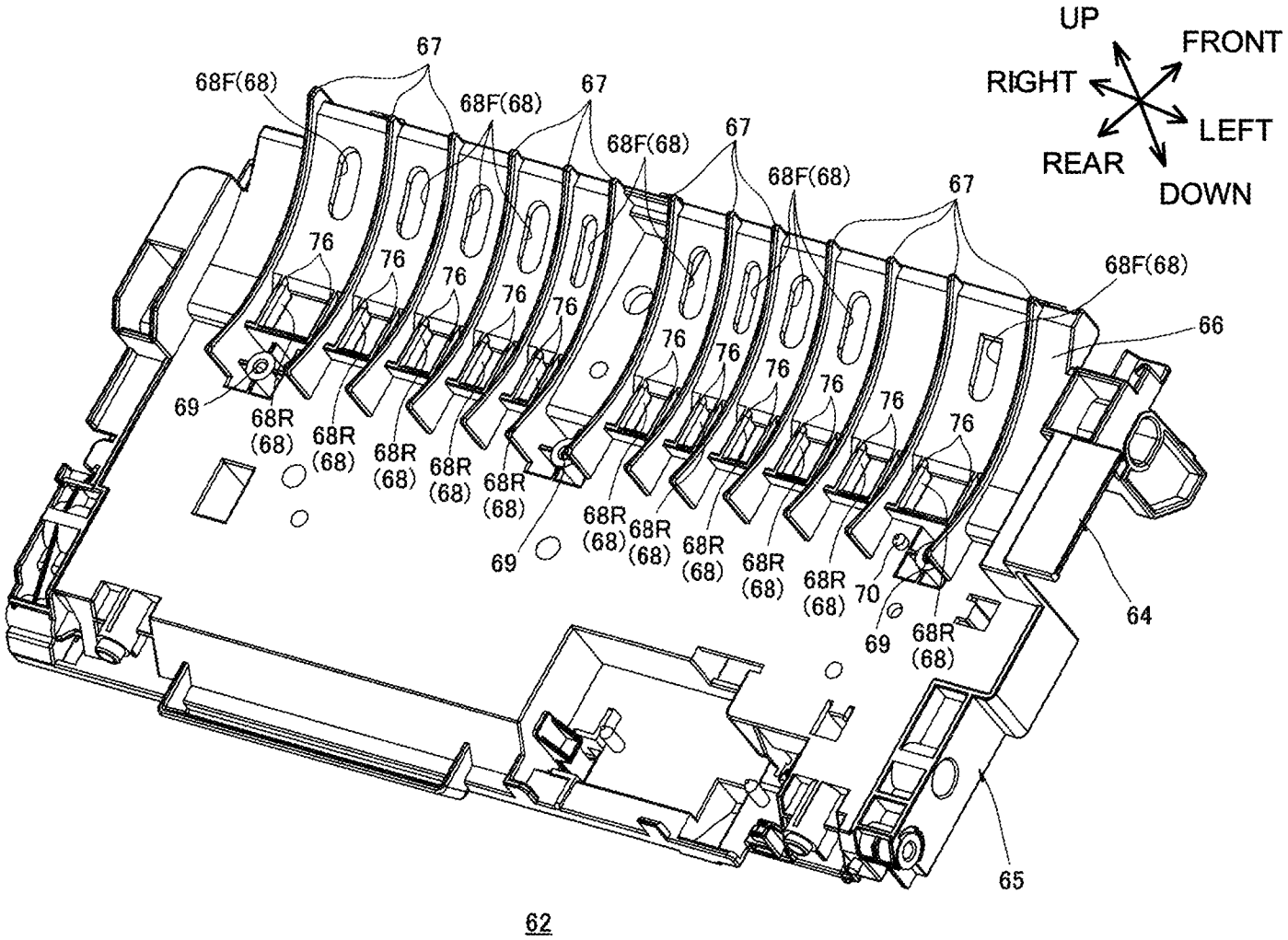
FIG. 3 illustrates, in a perspective view from the rear left side, a first lower wall formation member illustrated in FIG. 1 with a cover member being removed.
Figure 4:
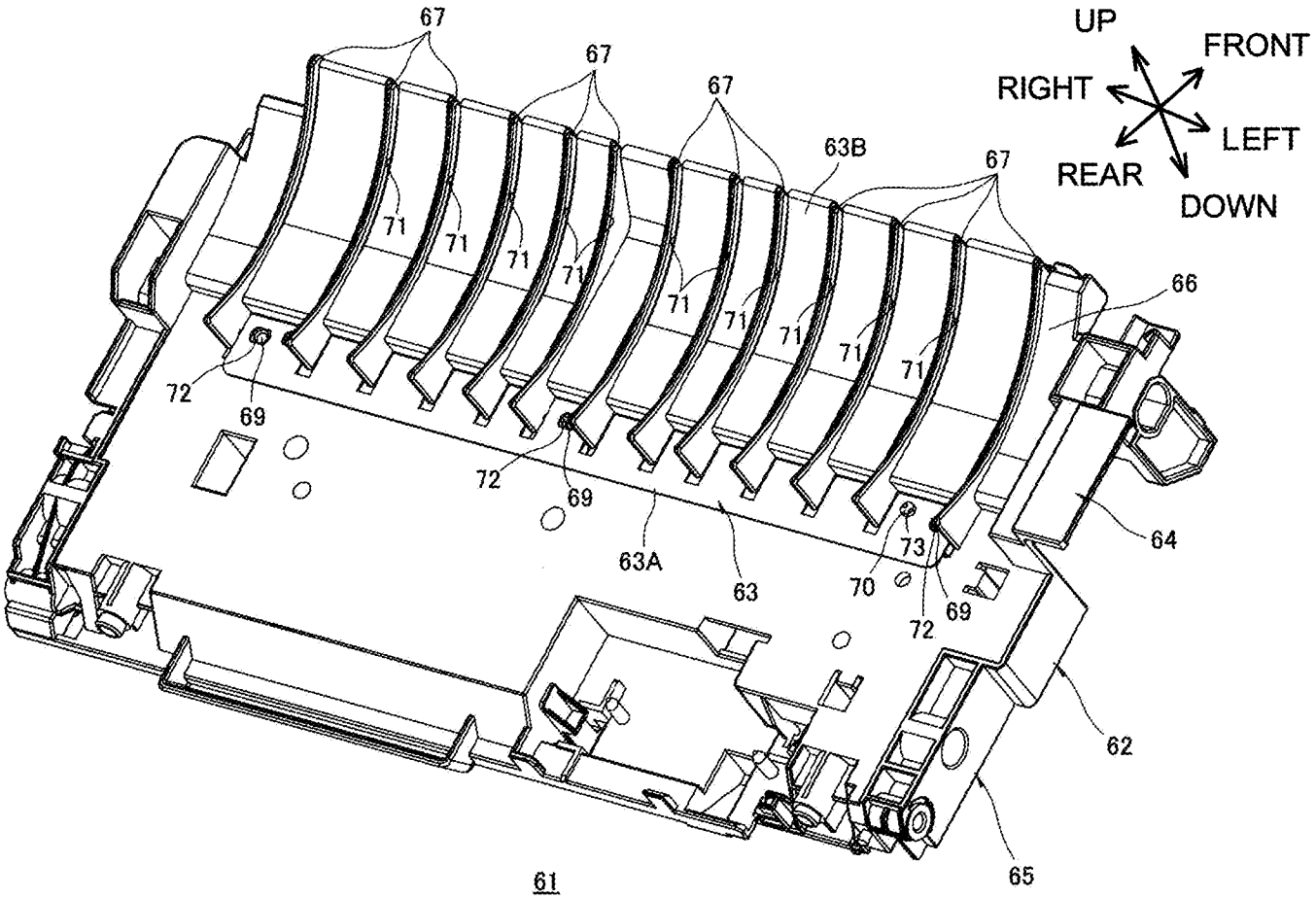
FIG. 4 illustrates, in a perspective view from the rear left side, the first lower wall formation member illustrated in FIG. 1 with the cover member being attached.

The first lower wall formation member 61 includes the frame 62 illustrated in FIG. 3 and a cover member 63 illustrated in FIG. 4, as an illustrative second member, which is assembled to a front end of the frame 62 from above. The first lower wall formation member 61 is formed as a substantially flat plate extending in the front-rear and left-right directions. A front end of the first lower wall formation member 61 is disposed at a position spaced below a rear end of the photoconductor drum 16 (see FIG. 1). The lower wall formation member 61 is fixed between the left and right side walls (not illustrated) of the main body 2 at the left and right ends thereof.

The frame 62 may be made of resin (e.g., polystyrene). The cover member 63 may be made of metal.

The frame 62, formed as a substantially flat plate extending in the front-rear and left-right directions, is provided integrally with a fixing unit support 65 which the supports the fixing device 20 and a first member, for example a path formation member 64.

The fixing unit support 65 forms a rear half of the frame 62 and is formed as a substantially flat plate having predetermined thickness (i.e., length in the up-down direction). The fixing unit support 65 has substantially the same length in the front-rear direction as that of the fixing device 20 (see FIG. 1).

The path formation member 64 forms a front half of the frame 62 and is provided with a curved plate 66 and rib 67. The curved plate 66 is curved upward as it approaches the front side. The ribs 67 are provided to protrude on the curved plate 66 extending in the front-rear direction. First through hole outlets such as through holes 68 are formed to pass through the path formation member 64 in the up-down direction.

The curved plate 66 extends upward from a front end of the fixing unit support 65, bent toward the front side and curved upward with the predetermined curvature as it approaches the front side. That is, the curved plate 66 is downwardly or concavely curved with the rear end being located at the lowest position and the front end being located at the highest position.

The ribs 67 are upward protrusions formed on the upper surface of the curved plate 66 and on an upper surface of the front end of the fixing unit support 65. The ribs 67 are arranged in parallel at certain intervals along the left-right direction. Upper end edges of the ribs 67 are curved with the same curvature as the curvature of the curved plate 66. Rear ends of the ribs 67 are located further rearward than the rear end of the curved plate 66. The upper end edges of the ribs 67 are curved upward as they approach the rear side.

The through holes 68 are arranged in series at the front end of the curved plate 66 and in series at the rear end of the curved plate 66 at certain intervals along the left-right direction. In the following description, the through holes 68 arranged on the front side will be referred to as front through holes 68F, and the through holes 68 arranged on the rear side will be referred to as rear through holes 68R.

Each of the front through holes 68F is formed as an elongated hole extending in the front-rear direction, and located between adjacent ribs 67 at the front end of the curved plate 66.

Each of the rear through holes 68R is formed in a substantially rectangular shape when seen in a plan view, and is located between adjacent ribs 67 at the rear end of the curved plate 66. The rear through holes 68R are located below the duct member 52 to face the same. In particular, the curved plate 66 is, at a portion between rear ends of adjacent ribs 67, divided into three sections by two partition plates 76 arranged in parallel spaced apart from each other. One of the rear through holes 68R is formed to pass through the curved plate 66 in the up-down direction at a position between the two partition plates 76 (i.e., a central section of the divided three sections). Sections between the rib 67 and the partition plate 76 (i.e., the left and right sections of the divided three sections) are closed.

In the frame 62, threaded holes 69 are formed at the front end of the fixing unit support 65 at positions of the left end, the right end and the center in the left-right direction. A substantially cylindrical positioning boss 70 protruding upward is formed near the left-side threaded hole 69.

The cover member 63 is curved to correspond to the shape of the path formation member 64 of the frame 62. In particular, the cover member 63 is provided integrally with a fixing unit 63A which is fixed to the front end of the fixing unit support 65, and a covering unit 63B which covers the path formation member 64 of the frame 62.

The fixing unit 63A is formed as a substantially flat plate extending in the left-right direction at the rear end of the cover member 63. In the fixing unit 63A, threaded insertion holes 72 are formed at the left end, the right end and the center in the left-right direction so as to correspond to the threaded holes 69 of the frame 62. In the fixing unit 63A, a positioning boss insertion hole 73, which is substantially round when seen in a plan view, is formed to pass through the fixing unit 63A at a position near the left-side threaded insertion hole 72 to correspond to the positioning boss 70 of the frame 62. The positioning boss 70 of the frame 62 is inserted in the positioning boss insertion hole 73. Thus, the cover member 63 is positioned with respect to the frame 62 in the front-rear direction and in the left-right direction.

The covering unit 63B extends upward from the front end of the fixing unit 63A, further upward than the rear end of the curved plate 66 and is bent toward the front side at the upper end thereof. The covering unit 63B is curved upward as it approaches the front side with the same curvature as the curvature of the curved plate 66 so as to face the curved plate 66 from above at some distance. That is, the covering unit 63B is also curved downward in the same manner as the curved plate 66.

The covering unit 63B is bent downward at the front end thereof to correspond to the front end of the path formation member 64 and extends in the up-down direction.

Second through hole outlets such as slits 71 extending in the front-rear direction are formed to pass through the cover member 63 in the up-down direction. Each of the slits 71 corresponds to each of the ribs 67.

Each slit 71 has a width (i.e., the length in the left-right direction) longer than the thickness (i.e., the length in the left-right direction) of each rib 67, and has a length in the front-rear direction longer than the length of each rib 67. The slits 71 are arranged parallel to one another at certain intervals along the left-right direction.

The cover member 63 covers the curved plate 66 of the frame 62 such that each rib 67 of the frame 62 is located inside each slit 71 protruding upward from the cover member 63. In this state, the cover member 63 covers the curved plate 66 of the frame 62 such that each slit 71 does not overlap each through hole 68 when projected in the up-down direction.

In this state, the positioning boss 70 of the frame 62 is inserted in the positioning boss insertion hole 73 of the cover member 63, and each threaded insertion hole 72 of the cover member 63 and each threaded hole 69 of the frame 62 are positioned to face each other in the up-down direction.

The cover member 63 is fixed to the frame 62 with screws (not illustrated) each inserted in the threaded hole 69 via the threaded insertion hole 72.

The cover member 63 is electrically connected to the main body casing 2 via predetermined wiring and is grounded electrically via the main body casing 2.

A reinforcing plate 74 that can be made of metal is provided below the first lower wall formation member 61 to extend between sides walls of the main body casing 2. The reinforcing plate 74 supports the first lower wall formation member 61 from below (see FIG. 1).

Figure 7:
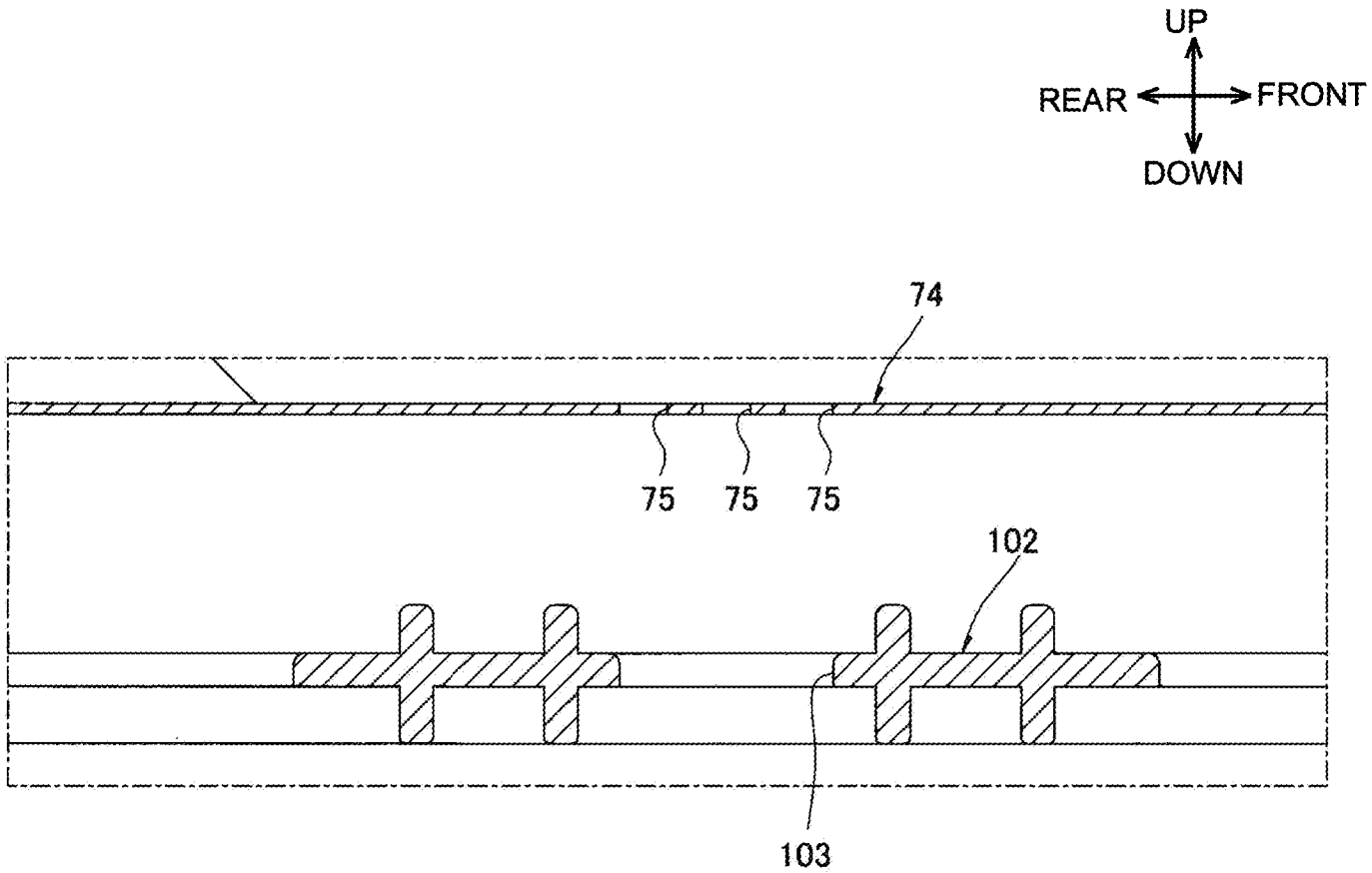
FIG. 7 is an enlarged view of an area W2 of the printer illustrated in FIG. 1.

Through holes 75 are formed to pass through the reinforcing plate 74 in the up-down direction at positions to face the rear through holes 68R in the up-down direction (see FIG. 7).

(2) Fixing Device

Figure 5:
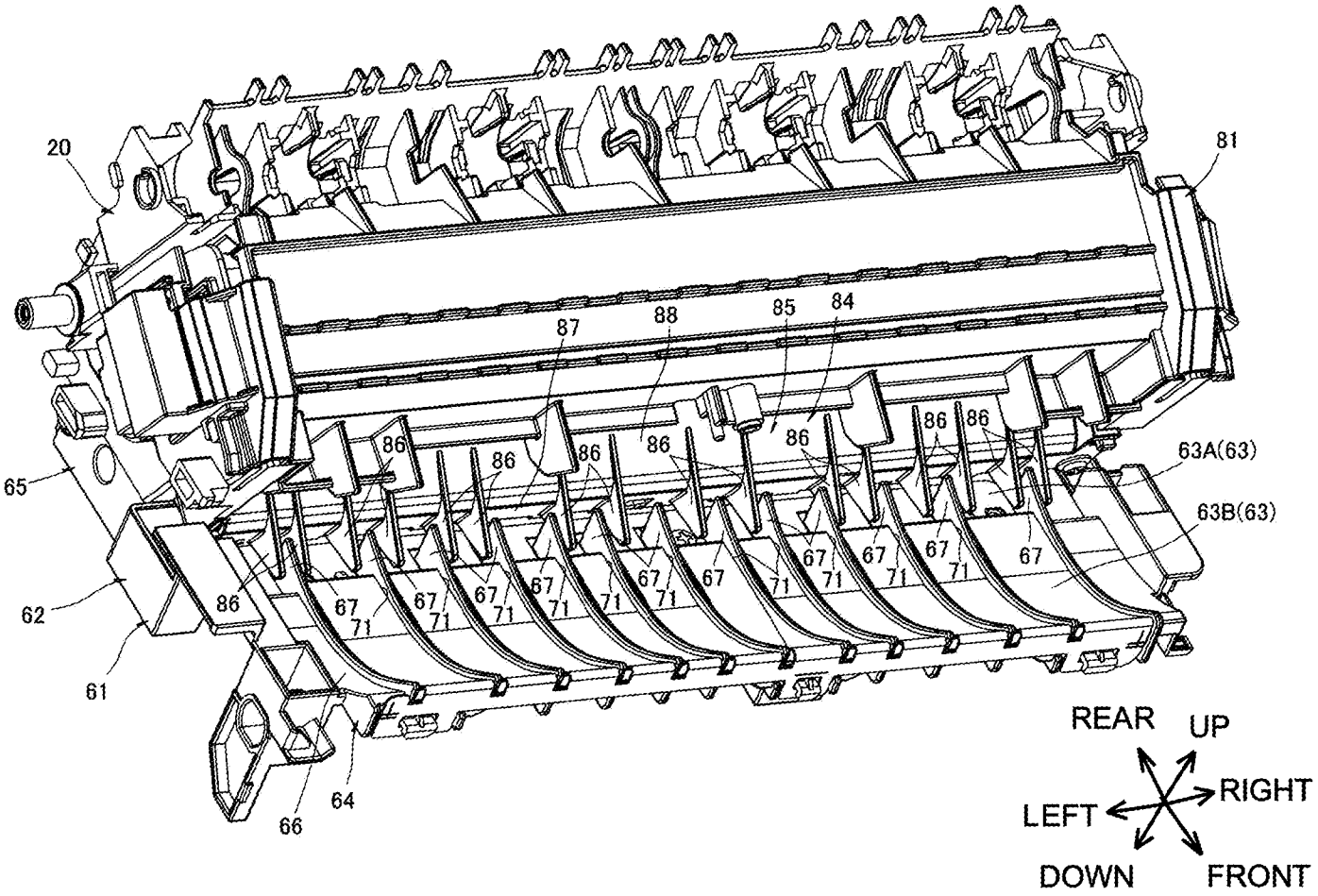
FIG. 5 illustrates, in a perspective view from the front left side, a fixing device and the first lower wall formation member illustrated in FIG. 1.
Figure 6:
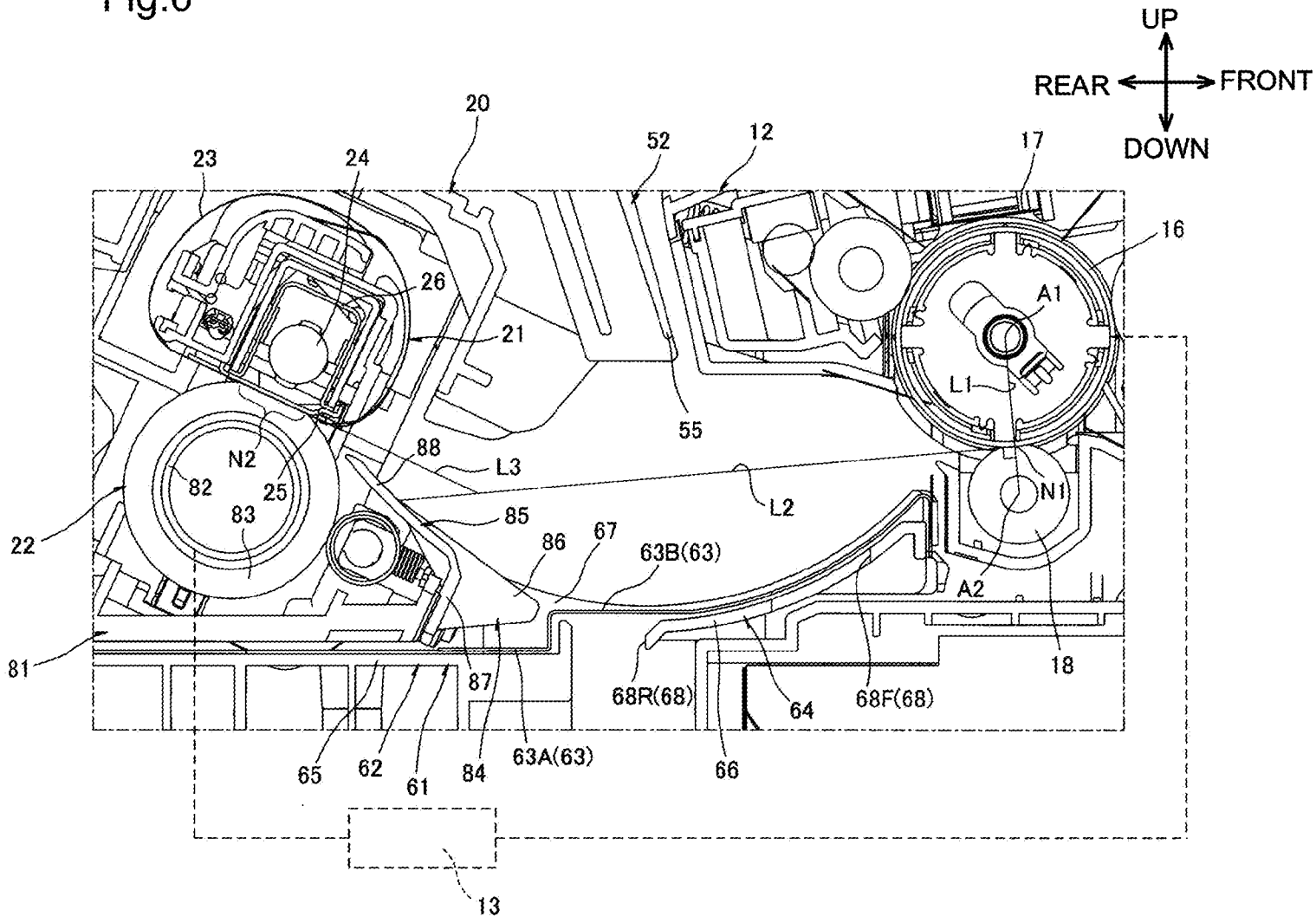
FIG. 6 is an enlarged view of an area W1 of the printer illustrated in FIG. 1.

As illustrated in FIGS. 5 and 6, the fixing device 20 is located on the rear side of the path formation member 64 of the first lower wall formation member 61 so as to be located above the fixing unit support 65 of the first lower wall formation member 61. Both ends in the front-rear direction of the fixing device 20 are fixed to the fixing unit support 65 of the first lower wall formation member 61. Both ends in the left-right direction of the fixing device 20 are positioned on the left-right direction side walls of the main body casing 2.

The fixing device 20 is provided with a fixing frame 81 which receives the heating unit 21 and the fixing roller 22.

The fixing frame 81 is formed as a substantial box-like shape extending in the left-right direction. The fixing frame 81 is opened at the front and rear sides of a contact area N2 in which the fixing frame 81 contacts the heating film 23 in the fixing roller 22.

The fixing frame 81 is provided with a fixing guide 84 which guides the paper sheet P to front side of the contact area N2.

The fixing guide 84, extending to the front side, may be made of resin which is heat resistant and has triboelectric series which tends to be negatively charged in comparison with those of the paper sheet P and the toner (e.g., polyethylene terephthalate). The fixing guide 84 is provided with, at the front side of the fixing roller 22, a cover plate 85 which covers a lower front end of the fixing frame 81, and guide ribs 86 extending from the cover plate 85 to a lower front side.

The cover plate 85, which is substantially L-shaped when seen in a side view, is provided with a guide fixing unit 87 extending in the up-down direction and a guide unit 88 extending in the upper rear direction from the upper end of the guide fixing unit 87.

The guide fixing unit 87 is screwed to the lower front end of the fixing frame 81 from the front side.

The guide unit 88 is curved upward as it approaches the rear side with the curvature smaller than a curvature of the upper end edge of the rib 67. That is, the upper end edge of the rib 67 is curved with the curvature larger than a curvature of the upper end surface of the guide unit 88.

The guide unit 88 crosses a second line L2 which perpendicularly crosses a first line L1 so as to pass through the contact area N1 of the photoconductor drum 16 and the transfer roller 18 when projected in the left-right direction. The first line L1 connects an axis A1 of the photoconductor drum 16 and an axis A2 of the transfer roller 18.

In the fixing device 20, the heating unit 21 contacts the fixing roller 22 from the upper front direction such that the contact area N2 is inclined upward as it approaches the rear side.

That is, the tangent line L3 and the second line L2 cross each other to form an imaginary downward protrusion above the path formation member 64 of the first lower wall formation member 61. The tangent line L3 contacts the center of the contact area N2 in the conveying direction (i.e., the upper rear side) of the paper sheet P. In particular, the second line L2 extends in the lower rear direction and the tangent line L3 extends in the lower front direction. The intersection point of the second line L2 and the tangent line L3 is located inside the curve of the first lower wall formation member 61 (i.e., inside the recess formed by the path formation member 64 and the fixing guide 84).

The guide ribs 86 protrude toward the front side from the front surface of the guide fixing unit 87 and from the front upper surface of the guide unit 88. Each of the guide ribs 86 is formed in a substantially triangular shape when seen in a side view having a vertex toward the lower front side. The guide ribs 86 are arranged in parallel at certain intervals along the left-right direction such that each of the guide ribs 86 is located between adjacent ribs 67 of the first lower wall formation member 61. Upper end edges of the guide ribs 86 are curved upward as they approach the rear side with the curvature smaller than each of the curvatures of the upper end edges of the ribs 67. That is, the upper end edge of the ribs 67 are curved with a curvature larger than each of the curvatures of upper end edges of the guide ribs 86.

Front ends of the guide ribs 86 overlap with the rear ends of the ribs 67 of the first lower wall formation member 61 when projected in the left-right direction, and are located further below the upper end edge of each rib 67 of the first lower wall formation member 61.

(3) Paper Sheet Output Guide

As illustrated in FIG. 1, a paper sheet output guide 91 is provided on the rear side of the fixing device 20 in the main body casing 2. The paper sheet P which has passed the contact area N2 of the fixing device 20 is turned upward along the paper sheet output guide 91.

The paper sheet output guide 91 is formed as a substantially flat plate having thickness in the front-rear direction and extending in the up-down direction. The curved surface 92 which is curved upward as it approaches the rear side is formed at the upper end of the paper sheet output guide 91.

(4) Conveyance of Paper Sheet in First Conveying Path

As described above, each paper sheet P is sent one at a time from the paper feed tray 8 to the resist roller 10 and is conveyed to the contact area N1 of the photoconductor drum 16 and the transfer roller 18 at predetermined times. After passing through the contact area N1, the paper sheet P is conveyed to the fixing device 20 and passes between the heating film 23 and the fixing roller 22. Then, the paper sheet P is turned upward along the paper sheet output guide 91 and is output to the paper output tray 27 through the paper sheet outlet 28 (a first conveying path).

In particular, the paper sheet P, which is conveyed to the fixing device 20 after passing the contact area N1 of the photoconductor drum 16 and the transfer roller 18, is first conveyed in the rear direction substantially along the second line L2 following the rotation of the photoconductor drum 16.

Then, the rear end (i.e., the downstream end in the conveying direction) of the paper sheet P contacts the guide unit 88 or the guide rib 86, is guided by the guide unit 88 in the upper rear direction and enters between the heating film 23 and the fixing roller 22.

Then, the paper sheet P is conveyed by rotation of the fixing roller 22 in the upper rear direction substantially along the tangent line L3.

The speed at which the photoconductor drum 16 conveys the paper sheet P is slightly higher than the speed at which the fixing roller 22 conveys the paper sheet P; the paper sheet P is conveyed at a distance spaced above the path formation member 64 from between the photoconductor drum 16 and the transfer rollers 18 to the fixing device 20.

The sponge roller 83 of the fixing roller 22 may expand due to the heat from the heating unit 21. If the sponge roller 83 expands, it is possible that the circumferential speed of the sponge roller 83 may be reduced and thus the paper sheet P may be loosened or curled concavely in an amount greater than expected.

However, even in such a case, the paper sheet P can be conveyed in a downwardly loosened manner to curl concavely since the path formation member 64 is curved downward.

4. Details of Second Conveying Path (1) Rear Cover

At a rear end of the main body casing 2, a rear cover 101 is provided spaced apart from the rear side of the paper sheet output guide 91 as illustrated in FIG. 1.

The rear cover 101 is formed as a substantially flat plate extending in the up-down direction. A front surface of the rear cover 101 is curved downward as it approaches the rear side.

(2) Second Lower Wall Formation Member

In the main body casing 2, a second lower wall formation member 102 which forms a lower wall of a second conveying path (described below) is provided above the paper feed tray 8, and spaced below the reinforcing member 74 as illustrated in FIGS. 1 and 7.

The second lower wall formation member 102 is formed as a substantially flat plate extending in the front-rear direction. A front end of the second lower wall formation member 102 is located closer to the lower side of the resist roller 10 and a rear end is located below the rear cover 101.

Through holes 103 are formed to pass through the second lower wall formation member 102 in the up-down direction so as to face the rear through holes 68R of the first lower wall formation member 61 in the up-down direction.

At the front side of the second lower wall formation member 102, a paper sheet re-feeding U-shaped path is provided further rearward than the paper sheet feeding U-shaped path. The paper sheet P is turned upward along the paper sheet re-feeding U-shaped path from the front side of the second lower wall formation member 102 to the resist roller 10.

(3) Conveyance of Paper Sheet in Second Conveying Path

The paper sheet P having an image printed on one surface thereof along the first conveying path is conveyed toward the paper output tray 27 through the paper sheet outlet 28 by the forward rotation of the output rollers 29.

If an image is to be formed on another surface of the paper sheet P ("double-sided printing"), an upstream end in the conveying direction (i.e., the rear end) of the paper sheet P is conveyed toward the paper output tray 27 until interference with the curved surface 92 of the paper sheet output guide 91 is eliminated and, then, the output rollers 29 are rotated backward before the paper sheet P is output on the paper output tray 27.

Then, the paper sheet P is conveyed from the rear end thereof to between the rear cover 101 and the paper sheet output guide 91 so as to be guided to the front surface of the rear cover 101.

That is, in the conveyance of the paper sheet P along the second conveying path, the upstream end in the conveying direction of the paper sheet P along the first conveying path becomes the downstream end in the conveying direction.

The paper sheet P is conveyed downward so as to pass between the rear cover 101 and the paper sheet output guide 91 (i.e., turned downward) and, then, is conveyed from the rear side (i.e., the side of the other horizontal end) to the front side (i.e., the side of one horizontal end) so that it may pass between the second lower wall formation member 102 and reinforcing plate 74.

The paper sheet P conveyed to the front end of the second lower wall formation member 102 is turned upward and fed again to the first conveying path on the front side of the resist roller 10.

5. Gas Exhaust from Main Body Casing

During the image formation operation described above, the temperature inside the main body casing 2 can become high due to heat from the fixing device 20.

The exhaust unit 51 is made to cool the inside of the main body casing 2. When the exhaust unit 51 operates, the fan 53 rotates to suck the air existing between the process cartridge 12 and the fixing device 20 into the duct body 54 via the duct partition plate 55. The air sucked into the duct body 54 is discharged out of the main body casing 2 through an exhaust port (not illustrated) formed to pass through a right wall of the main body casing 2.

When the air existing between the process cartridge 12 and the fixing device 20 is sucked, the air flows from the second conveying path to the first conveying path so as to pass through the through holes 75 of the reinforcing board 74 (see FIG. 7), the through holes 68 of the path formation member 64 and the slits 71 of the cover member 63.

When the air inside the second conveying path flows into the first conveying path, the air (ambient air) outside the main body casing 2 is taken in the second conveying path and flows through the second lower wall formation member 102 and the paper feed trays 8 via a gap at the rear end of the main body casing 2 and, then, flows into the second conveying path via the through holes 103 of the second lower wall formation member 102.

In summary, the ambient air is introduced from the rear end of the main body casing 2, passes between the second lower wall formation member 102 and the paper feed trays 8, flows into the second conveying path via the through holes 103 of the second lower wall formation member 102, and then flows into the first conveying path via the through holes 75 of the reinforcing board 74, the through holes 68 of the path formation member 64 and the slits 71 of the cover member 63 in this order.

The air flown into the first conveying path moves upward between the process cartridge 12 and the fixing device 20, is sucked into the duct body 54 from the duct partition plate 55, and then is discharged out of the main body casing 2 through the exhaust port (not illustrated) formed to pass through the right wall of the main body casing 2.

6. Operation And Effect (1) According to the printer 1, as illustrated in FIGS. 1 and 4, the first lower wall formation member 61 which forms the first conveying path of the paper sheet P from the image forming unit 4 to the fixing device 20 is provided with the path formation member 64 and the cover member 63. The through holes 68 are formed to pass through the path formation member 64 in the up-down direction. The slits 71 are formed to pass through the cover member 63 in the up-down direction. The cover member 63 faces and is spaced apart from the path formation member 64 from above. The cover member 63 faces the path formation member 64 such that the slits 71 do not overlap the through holes 68 when projected in the up-down direction.

Therefore, an air flow in the up-down direction can be produced through the through holes 68, between the path formation member 64 and the cover member 63, and the slits 71.

Since the through holes 68 and the slits 71 do not overlap when projected in the up-down direction, even if the toner yet to be fixed drops from the paper sheet P which is being conveyed from the image forming unit 4 to the fixing device 20, it is possible to prevent any dropped toner from passing through both the through holes 68 and the slits 71.

It is therefore possible to prevent dropped toner from being scattered further downward than the first conveying path and scattered out of the first conveying path.

(2) According to the printer 1, as illustrated in FIGS. 3 and 4, the through holes 68 are arranged in parallel at certain intervals in the left-right direction and in two rows in the front-rear direction; and the slits 71 are arranged in parallel at certain intervals in the left-right direction such that each of the slits 71 is located between adjacent through holes 68 when projected in the up-down direction.

That is, the through holes 68 and the slits 71 are arranged not to overlap one another when projected in the up-down direction.

Therefore, even if a plurality of through holes 68 and a plurality of slits 71 are provided, it is possible to prevent dropped toner from being scattered further downward than the first conveying path.

(3) According to the printer 1, the cover member 63 may be made of metal and grounded electrically.

With this configuration, potential difference can be produced between the paper sheet P, which is electrically charged by the transfer bias applied thereto during the transfer of the toner image, and the cover member 63; it is therefore possible to attract the electrically charged paper sheet P to the cover member 63.

Thus, the air flow passing between the process cartridge 12 and the fixing device 20 can prevent the paper sheet P from being raised upward while being conveyed from the process cartridge 12 to the fixing device 20.

It is therefore possible that the paper sheet P can be conveyed smoothly from the process cartridge 12 to the fixing device 20.

(4) According to the printer 1, as illustrated in FIGS. 3 and 4, the path formation member 64 can be provided with resin-made ribs 67 each located in each of the slits 71 and protruding further upward than the cover member 63.

If, for example, the paper sheet P is loosened or curls concavely in an amount greater than expected during conveyance, the paper sheet P approaches the ribs 67. The cover member 63 is grounded electrically, and force to attract the paper sheet P thereto is produced. However, if the paper sheet P is excessively attracted to the cover member 63, smooth conveyance of the paper sheet P becomes difficult.

In order to avoid such a situation, the ribs 67 are provided for conveying the paper sheet P such that the paper sheet P which has been loosened or curled concavely in an amount greater than expected does not directly contact the cover member 63.

It is therefore possible to convey the paper sheet P smoothly while attracting the paper sheet P appropriately.

(5) According to the printer 1, as illustrated in FIG. 6, the path formation member 64 and the cover member 63 are curved downward.

The thus curved path formation member 64 and the cover member 63 absorb the downward loosening or concave curling of the paper sheet P.

Therefore, the loosening or concave curling of the paper sheet P can be absorbed sufficiently even if the paper sheet P is loosened or curled concavely during the conveyance from the process cartridge 12 to the fixing device 20.

(6) According to the printer 1, as illustrated in FIG. 1, the second conveying path which feeds the paper sheet P having an image fixed thereto in the fixing device 20 again to the image forming unit 4 can be provided below the image forming unit 4, the path formation member 64, and the fixing device 20.

It is therefore possible to prevent a developing agent yet to be fixed from dropping from the paper sheet P onto the second conveying path below the path formation member 64 while the paper sheet P is conveyed from the image forming unit 4 to the fixing device 20.

(7) As illustrated in FIG. 1, the printer 1 is provided with the duct member 52 which is located to face the path formation member 64 from above and discharges the air out of the main body casing 2.

Therefore, the air existing between the process cartridge 12 and the fixing device 20 can be reliably discharged out of the main body casing 2 via the duct member 52.

It is therefore possible to cool the space between the process cartridge 12 and the fixing device 20.

7. Modifications (1) A plurality of through holes 68 and slits 71 are provided in the above-described illustrative embodiment, but, for example, a single through hole 68 and a single slit 71 may be provided.

(2) The cover member 63 can be made of metal and grounded electrically in the above-described illustrative embodiment, but the cover member 63 may also be made of other materials, such as resin.

(3) The path formation member 64 and the cover member 63 are curved downward in the above-described illustrative embodiment. However, the path formation member 64 and the cover member 63 may also be formed as, for example, flat surfaces.

(4) The second conveying path along which the paper sheet P having an image fixed thereto is conveyed again to the image forming unit 4 is provided in the above-described illustrative embodiment. However, the second conveying path may be omitted.

(5) The paper sheet P is described as an illustrative transfer-receiving member in the above-described illustrative embodiment, but other transfer-receiving members, such as an OHP sheet, may also be used.

(6) The heating unit 21 of the fixing unit 5 employs the heating film 23 for the fixation in the above-described illustrative embodiment. However, for example, a fixing device using a member other than film to cover the heating member 24 (in particular, a fixing unit provided with a heat roller including a metal element tube for covering the heating member 24) may also be used.

(7) The fixing roller 22 is driven to rotate by the driving force from the motor 13 which is common with the photoconductor drum 16 in the above-described illustrative embodiment but, the fixing roller 22 and the photoconductor drum 16 may have their own motor.

According to these modifications (1) to (7), it is possible to obtain the same operation and effect as those of the illustrative embodiment described above.

What is claimed is:

1. An image forming apparatus, comprising:

an apparatus main body;

an image forming unit provided in the apparatus main body and configured to form an image on a transfer-receiving member while conveying the transfer-receiving member from a first side to a second side;

a fixing device disposed to be spaced apart from the image forming unit in the apparatus main body and on a side of the image forming unit closer to the second side, and configured to fix the image formed on the transfer-receiving member;

a first conveying path formation member, disposed between the image forming unit and the fixing device in the apparatus main body, and configured to form a first conveying path along which the transfer-receiving member is conveyed from the image forming unit to the fixing device, wherein the first conveying path formation member includes:

a first member having first through holes in an up-down direction, and a second member having second through holes in the up-down direction, and disposed to be spaced above the first member and to face the first member, wherein the second member faces the first member such that the second through holes do not overlap the first through holes when projected in the up-down direction; and a second conveying path formation member disposed below the image forming unit, the first conveying path formation member and the fixing device, and configured to form a second conveying path along which the transfer-receiving member having an image fixed thereto is conveyed, wherein the second conveying path formation member includes:

a third member having at least one third through hole in the up-down direction, wherein the at least one third through hole is arranged such that it overlaps with at least one first through hole when projected in the up-down direction.

2. The image forming apparatus according to claim 1, wherein:

the first through holes are each provided a predetermined distance from a neighboring one of the first through holes along an orthogonal direction which crosses perpendicularly to a conveying direction of the transfer-receiving member and the up-down direction; and the second through holes are each provided a predetermined distance between neighboring ones of the first through holes when projected in the up-down direction.

3. The image forming apparatus according to claim 1, wherein the second member is made of metal and is grounded electrically.

4. The image forming apparatus according to claim 3, wherein:

the second through holes are slits extending in a conveying direction of the transfer-Receiving member; and the first member is made of resin and includes ribs which extend in the conveying direction in the second through holes and protrude further upward than the second member.

5. The image forming apparatus according to claim 1, wherein the first member and the second member are concavely curved.

6. The image forming apparatus according to claim 1, wherein, along the second conveying path, the transfer-receiving member having the image fixed thereto is conveyed in a downward direction and then from the first side to the second side and then to the first conveying path.

7. The image forming apparatus according to claim 1, further comprising a duct member, which is provided above and faces the first conveying path formation member in the apparatus main body, and which is configured to allow air inside the apparatus main body to be discharged from the apparatus main body.

8. The image forming apparatus of claim 1, further comprising a reinforcing plate disposed below the image forming unit, the first conveying path formation member and the fixing device, and disposed above the second conveying path formation member, wherein the reinforcing plate includes:

at least one fourth through hole in the up-down direction, wherein the at least one fourth through hole is arranged such that it overlaps with the at least one first through hole and the at least one third through hole in the up-down direction.

9. An image forming apparatus, comprising:

an apparatus main body;

an image forming unit provided in the apparatus main body and configured to form an image on a transfer-receiving member while conveying the transfer-receiving member from a first side to a second side;

a fixing device disposed to be spaced apart from the image forming unit in the apparatus main body and on a side of the image forming unit closer to the second side, and configured to fix the image formed on the transfer-receiving member;

a first conveying path formation member, disposed between the image forming unit and the fixing device in the apparatus main body, and configured to form a first conveying path along which the transfer-receiving member is conveyed from the image forming unit to the fixing device, wherein the first conveying path formation member includes:

a first member having first through holes in an up-down direction, and a second member having second through holes in the up-down direction, and disposed to be spaced above the first member and to face the first member, wherein the second member faces the first member such that no portion of any of the second through holes overlap any portion of any of the first through holes when projected in the up-down direction, and such that an air flow path is formed through the first through holes, between the first member and the second member, and through the second through holes; and a second conveying path formation member disposed below the image forming unit, the first conveying path formation member and the fixing device, and configured to form a second conveying path along which the transfer-receiving member having an image fixed thereto is conveyed, wherein the second conveying path formation member includes:

a third member having at least one third through hole in the up-down direction, wherein the at least one third through hole is arranged such that it overlaps with at least one first through hole when projected in the up-down direction.

10. The image forming apparatus according to claim 9, wherein:

the first through holes are each provided a predetermined distance from a neighboring one of the first through holes along an orthogonal direction which crosses perpendicularly to a conveying direction of the transfer-receiving member and the up-down direction; and the second through holes are each provided a predetermined distance between neighboring ones of the first through holes when projected in the up-down direction.

11. The image forming apparatus according to claim 9, wherein the first member and the second member are concavely curved.

12. The image forming apparatus according to claim 9, wherein, along the second conveying path, the transfer-receiving member having the image fixed thereto is conveyed in a downward direction and then from the first side to the second side and then to the first conveying path.

13. The image forming apparatus according to claim 9, further comprising a duct member, which is provided above and faces the first conveying path formation member in the apparatus main body, and which is configured to allow air inside the apparatus main body to be discharged from the apparatus main body.

14. The image forming apparatus of claim 9, further comprising a reinforcing plate disposed below the image forming unit, the first conveying path formation member and the fixing device, and disposed above the second conveying path formation member, wherein the reinforcing plate includes:

at least one fourth through hole in the up-down direction, wherein the at least one fourth through hole is arranged such that it overlaps with the at least one first through hole and the at least one third through hole in the up-down direction.

15. An image forming apparatus, comprising:

an apparatus main body;

an image forming unit provided in the apparatus main body and configured to form an image on a transfer-receiving member while conveying the transfer-receiving member from a first side to a second side;

a fixing device disposed to be spaced apart from the image forming unit in the apparatus main body and on a side of the image forming unit closer to the second side, and configured to fix the image formed on the transfer-receiving member; and a first conveying path formation member, disposed between the image forming unit and the fixing device in the apparatus main body, and configured to form a first conveying path along which the transfer-receiving member is conveyed from the image forming unit to the fixing device, wherein the first conveying path formation member includes:

a first member having first through holes in an up-down direction; and a second member having second through holes in an up-down direction, and disposed to be spaced above the first member and to face the first member, wherein the second member faces the first member such that the second through holes do not overlap the first through holes when projected in the up-down direction, and wherein the image forming apparatus further comprises a duct member, which is provided above and faces the first conveying path formation member in the apparatus main body, and which is configured to allow air inside the apparatus main body to be discharged from the apparatus main body, and wherein the duct member includes:

a duct body; and a duct partition plate extending downward from the duct body such that a lower end of the duct partition plate forms a lowermost portion of the duct member in the up-down direction, wherein the lower end of the duct partition plate includes an opening located between the image forming unit and the fixing device.

16. The image forming apparatus according to claim 15, wherein:

the first through holes are each provided a predetermined distance from a neighboring one of the first through holes along an orthogonal direction which crosses perpendicularly to a conveying direction of the transfer-receiving member and the up-down direction; and the second through holes are each provided a predetermined distance between neighboring ones of the first through holes when projected in the up-down direction.

17. The image forming apparatus according to claim 15, wherein the second member is made of metal and is grounded electrically.

18. The image forming apparatus according to claim 17, wherein:

the second through holes are slits extending in a conveying direction of the transfer-receiving member; and the first member is made of resin and includes ribs which extend in the conveying direction in the second through holes and protrude further upward than the second member.

19. The image forming apparatus according to claim 15, wherein the first member and the second member are concavely curved.

20. The image forming apparatus according to claim 15, further comprising a second conveying path disposed below the image forming unit, the first conveying path formation member and the fixing device, wherein, along the second conveying path, the transfer-receiving member having an image fixed thereto is conveyed in a downward direction and then from the first side to the second side and then to the first conveying path.

* * * * *